US007011362B1

(12) United States Patent
Huang

(10) Patent No.: US 7,011,362 B1
(45) Date of Patent: Mar. 14, 2006

(54) STRUCTURE OF A SECURING MECHANISM FOR A BACK OF AN ADJUSTABLE RECLINING CHAIR

(76) Inventor: Chi-Tzung Huang, No. 20, Industry 3rd Road, Min Hsiung, Chia Yi Hsien (TW)

( * ) Notice: Subject to any disclaimer, the term of this patent is extended or adjusted under 35 U.S.C. 154(b) by 0 days.

(21) Appl. No.: 10/972,375

(22) Filed: Oct. 26, 2004

(51) Int. Cl.
*A47C 1/02* (2006.01)

(52) U.S. Cl. ..... 297/89; 297/88; 297/68; 297/84; 297/325; 297/354.1; 297/354.12

(58) Field of Classification Search ..... 297/89, 297/88, 68, 84, 325, 354.1, 354.12
See application file for complete search history.

(56) References Cited

U.S. PATENT DOCUMENTS 1,312,720 A * 8/1919 Bostwick ..... 297/88 X
2,613,727 A * 10/1952 Lorenz ..... 297/88 X
2,746,521 A * 5/1956 Lorenz ..... 297/88
2,760,554 A * 8/1956 Lorenz ..... 297/88
2,774,412 A * 12/1956 Luckhardt ..... 297/88 X
2,890,742 A * 6/1959 Fletcher ..... 297/82
2,908,321 A * 10/1959 Lorenz ..... 297/88 X
2,918,113 A * 12/1959 Lorenz ..... 297/89
2,944,594 A * 7/1960 Lorenz ..... 297/89
2,964,096 A * 12/1960 Krikorian ..... 297/89
2,978,011 A * 4/1961 Lorenz ..... 297/85
3,028,195 A * 4/1962 Lorenz ..... 297/89
3,032,372 A * 5/1962 Schliephacke ..... 297/89
3,041,106 A * 6/1962 Fletcher ..... 297/89
3,049,375 A * 8/1962 Carlson ..... 297/88 X
3,062,581 A * 11/1962 Fletcher ..... 297/89
3,065,024 A * 11/1962 Fletcher ..... 297/89
3,147,038 A * 9/1964 Barabas ..... 297/89
4,045,081 A * 8/1977 Ueno ..... 297/354.12 X
4,072,341 A * 2/1978 Kurz ..... 297/359 X
4,078,841 A * 3/1978 Kiang ..... 297/68

(Continued)

FOREIGN PATENT DOCUMENTS

DE 3234836 A1 * 3/1984 ..... 297/68

(Continued)

*Primary Examiner*—Rodney B. White
(74) *Attorney, Agent, or Firm*—Rosenberg, Klein & Lee

(57) ABSTRACT

A reclining chair includes a securing mechanism used for releaseably securing an angularly displaceable back; the back has a support rod pivoted thereto; the mechanism includes first and second rotary shafts, first and second pedals and first and second reels respectively secured on the shafts, a string wound onto the first reel at one end, and onto the second reel at other end for effecting simultaneous rotation of the shafts, and a securing element near to the support rod and connected to the second shaft; the securing element is formed in such a way as to be capable of securing the support rod in position immediately after it is turned to a first position by depressing the first pedal, and capable of releasing the support rod for the back to be steplessly adjusted immediately after it is turned away from the first position by depressing the second pedal.

1 Claim, 9 Drawing Sheets

U.S. PATENT DOCUMENTS

| | | | | | |
|---|---|---|---|---|---|
| 4,167,288 | A * | 9/1979 | Kiang | 297/68 X |
| 4,285,541 | A * | 8/1981 | Onishi | 297/84 |
| 4,451,082 | A * | 5/1984 | Giordani | 297/68 X |
| 4,792,181 | A * | 12/1988 | Guichon | 297/68 X |
| 5,082,324 | A * | 1/1992 | Harada et al. | 297/68 X |
| 5,348,367 | A * | 9/1994 | Mizelle | 297/68 X |
| 5,547,256 | A * | 8/1996 | D'Antuono et al. | 297/68 X |
| 5,868,461 | A * | 2/1999 | Brotherston | 297/84 |
| 6,217,114 | B1 * | 4/2001 | Degonda | 297/325 |
| 6,402,232 | B1 * | 6/2002 | Tsai | 297/68 |
| 6,604,791 | B1 * | 8/2003 | Chen | 297/68 X |
| 6,616,232 | B1 * | 9/2003 | Herman et al. | 297/325 |
| 2002/0185899 | A1 * | 12/2002 | Herman et al. | 297/325 |
| 2004/0021354 | A1 * | 2/2004 | Hogg | 297/325 |
| 2005/0140183 | A1 * | 6/2005 | Conte | 297/68 |

FOREIGN PATENT DOCUMENTS

| | | | | |
|---|---|---|---|---|
| DE | 3424359 | A1 * | 1/1985 | 297/84 |
| DE | 3413821 | A1 * | 10/1985 | 297/354.1 |
| FR | 2596627 | A1 * | 10/1987 | 297/68 |
| FR | 2677237 | A1 * | 12/1992 | 297/68 |
| GB | 2158350 | A * | 11/1985 | 297/84 |
| JP | 58000428 | A * | 1/1983 | 297/84 |

* cited by examiner

STRUCTURE OF A SECURING MECHANISM FOR A BACK OF AN ADJUSTABLE RECLINING CHAIR

BACKGROUND OF THE INVENTION

1. Field of the Invention

The present invention relates to a reclining chair, more particularly one whose back is steplessly adjustable so that one person will be able to displace the back to any reclining position according to his need, thus making the reclining chair even more comfortable to lie on.

2. Brief Description of the Prior Art

Referring to FIG. 8, a conventional reclining chair 4 includes a frame, a back 44, a footrest 46, a pair of connecting rods 441, and a securing mechanism, which is used for securing the back 44 after the same is angularly displaced to a suitable position.

The frame has two lateral parts 41, a first transverse rod 21 at a rear end, and a second transverse rod 45 between front and rear ends thereof.

The back 4 is angularly displaceably fitted to the frame, and it has a transverse support rod 47. The footrest 46 is pivoted to the front end of the frame.

In addition, two hollow holding elements 442 are fitted to the second transverse rod 45 of the frame. And, the connecting rods 441 are passed through the hollow holding elements 442 respectively, and they are pivoted to the back 44 at rear ends and the footrest 46 at front ends; thus, the footrest 46 and the back 44 can be simultaneously adjusted in position.

The securing mechanism includes a rotary shaft 43 parallel to and supported on the first transverse rod 21 of the frame, a pedal 431 securely joined to one end of the rotary shaft 43, a semicircular pushing member 432 securely joined to the other end of the shaft 43, two apart and opposing plates 421 secured on the first transverse rod 21 of the frame, an engaging pin 422 joined to the plates 421 at two ends thereof, and an engaging rod 48, which is pivoted to the transverse support rod 41 of the back 4 at an upper end and passed between the plates 421. The engaging rod 48 is formed with several spaced engaging gaps 481. And, an elastic element 482 is connected with the transverse support rod 47 and the engaging rod 48 at two ends thereof for biasing the engaging rod 48 to the engaging pin 422. Therefore, the engaging rod 48 can be secured in position with one of the engaging gaps 481 being fitted on the engaging pin 422. In addition, the engaging rod 48 is close to the semicircular pushing member 432 at a lower end so that it will disengage the pin 422 as soon as the pushing member 432 is forced to move forwards.

Consequently, the engaging rod 48 will disengage the engaging pin 422 as soon as the pedal 431 is depressed, allowing the engaging rod 48 to be linearly displaced relative to the engaging pin as well as allowing the back 44 to be angularly displaced relative to the frame for adjustment in position. After the back 44 is angularly displaced to a desired position, and one stops depressing the pedal 431, the engaging rod 48 will engage the engaging pin 422 again to secure the back 44 in the desired position.

Therefore, the back 44 can be adjusted in position according to the sitter's need. However, because the engaging rod 48 has a finite number of engaging gaps 481, there are only a limited number of different positions for the back 44 to be selectively displaced to. In other words, the back 44 can't be adjusted to any reclining position, and it isn't ergonomically ideal.

SUMMARY OF THE INVENTION

It is a main object of the invention to provide an improvement on a securing mechanism used for releaseably securing an angularly adjustable back of a reclining chair to overcome the above disadvantage.

The back has a support rod pivoted thereto while the securing mechanism used includes first and second rotary shafts, first and second pedals and first and second reels respectively secured on the shafts, a string wound onto the first reel at one end, and onto the second reel at other end for effecting simultaneous rotation of the shafts, and a securing element near to the support rod and connected to the second shaft. The securing element is formed in such a way as to be capable of securing the support rod in position immediately after it is turned to a first position by depressing the first pedal, and capable of releasing the support rod immediately after it is turned away from the first position by depressing the second pedal. Therefore, the back is steplessly adjustable, and one can move the back to any suitable reclining position according to his/her need.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
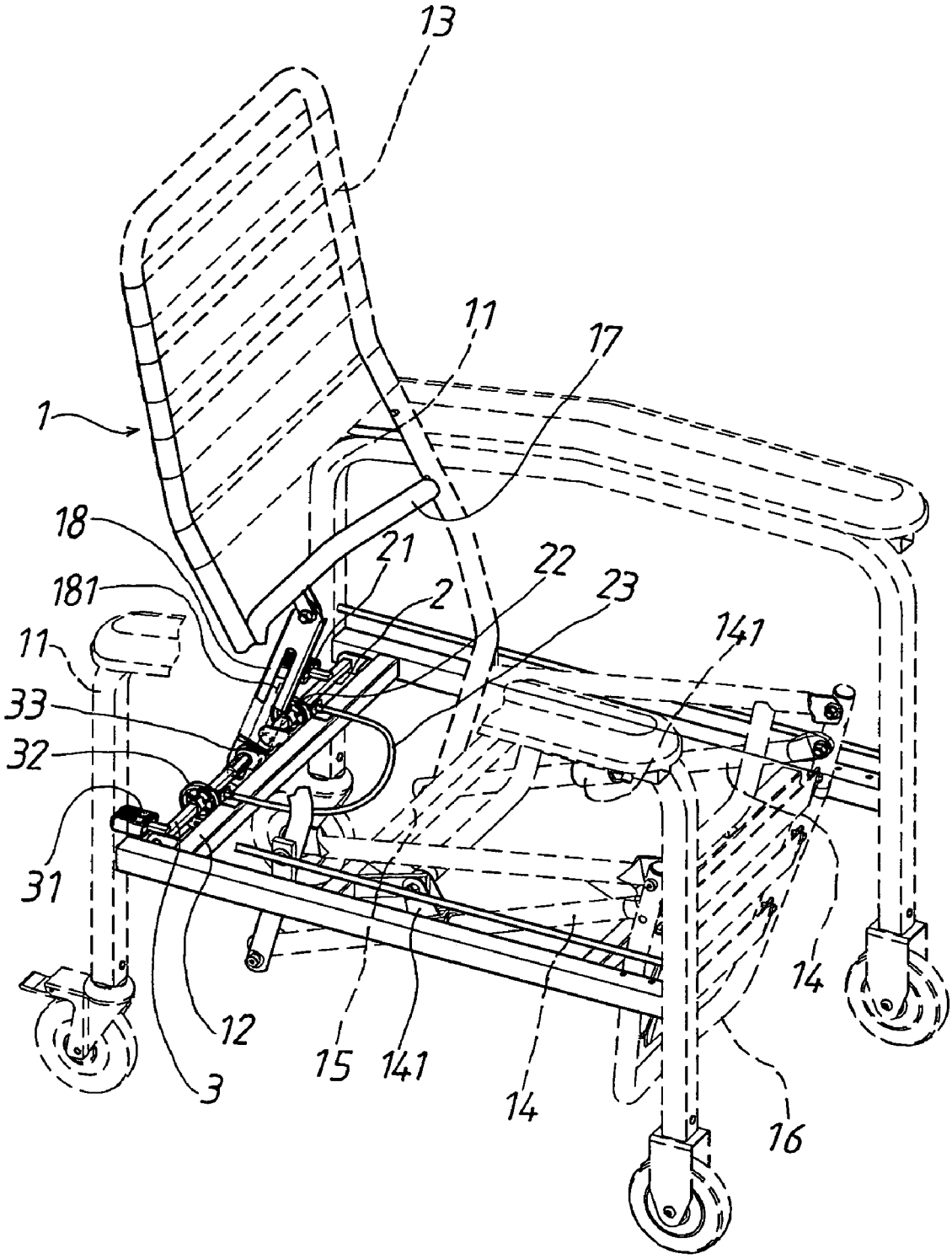
FIG. 1 is a perspective view of the reclining chair according to the present invention.
Figure 2:
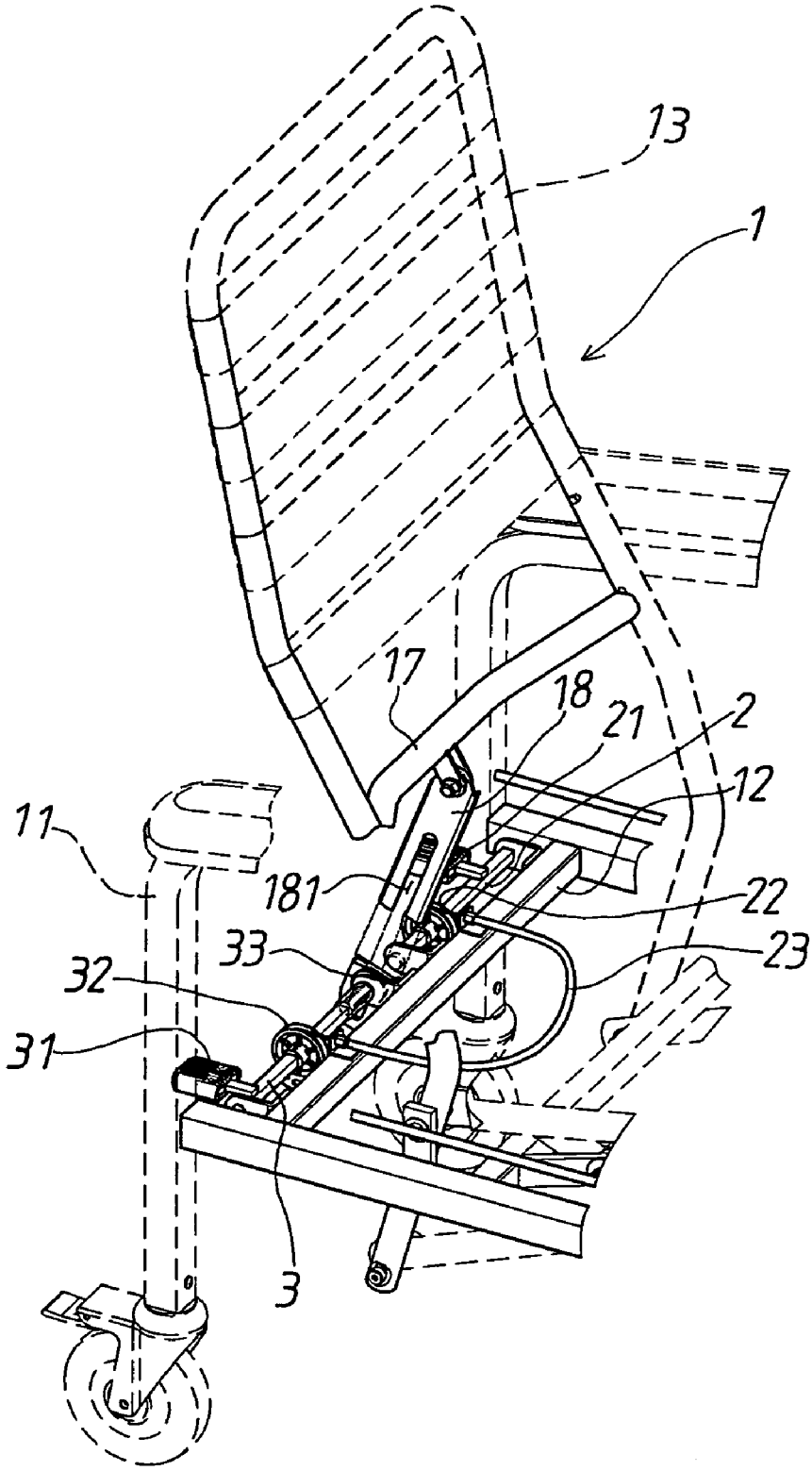
FIG. 2 is a partial perspective view of the present reclining chair.
Figure 3:
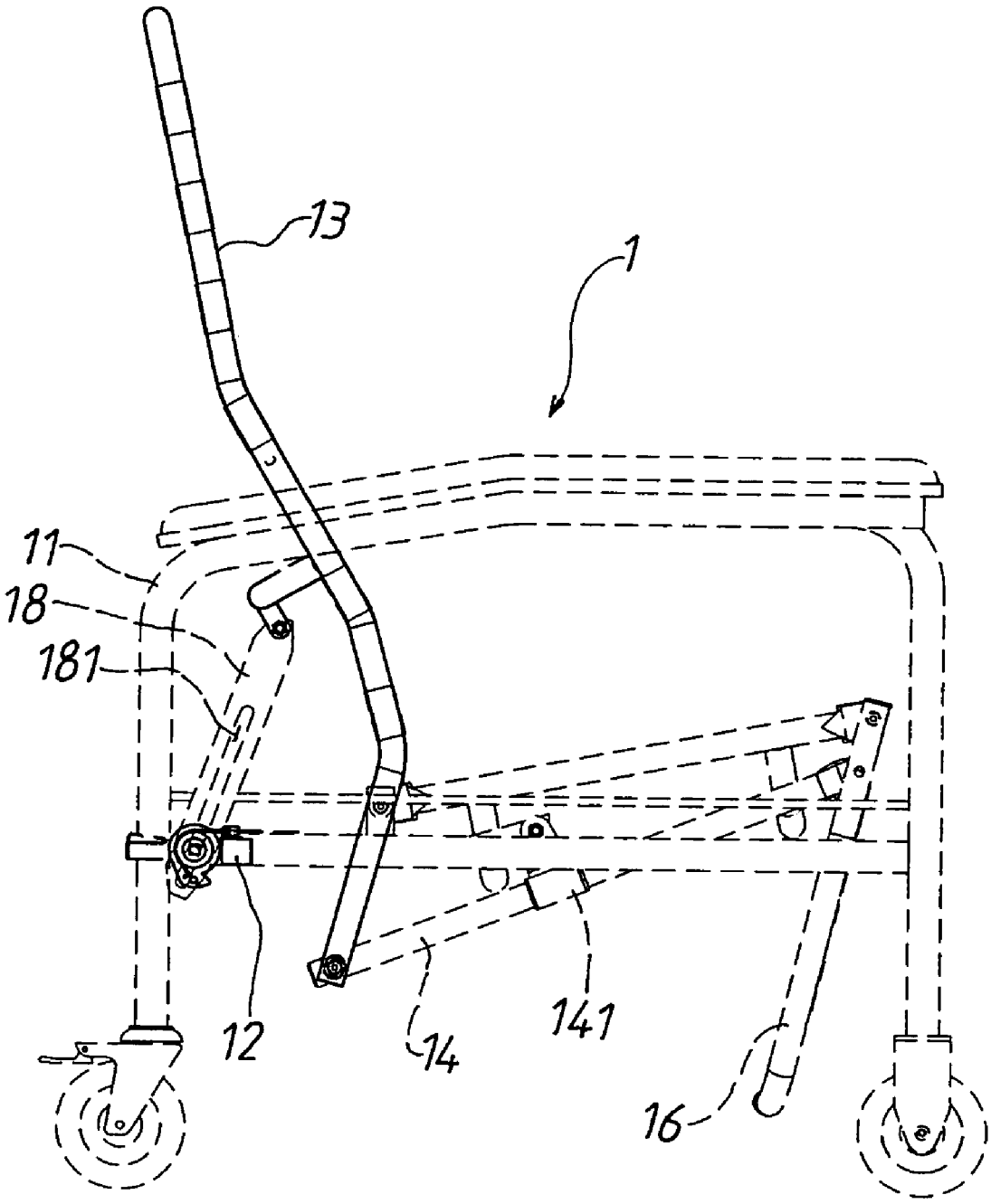
FIG. 3 is a side view of the reclining chair in the present invention.
Figure 4:
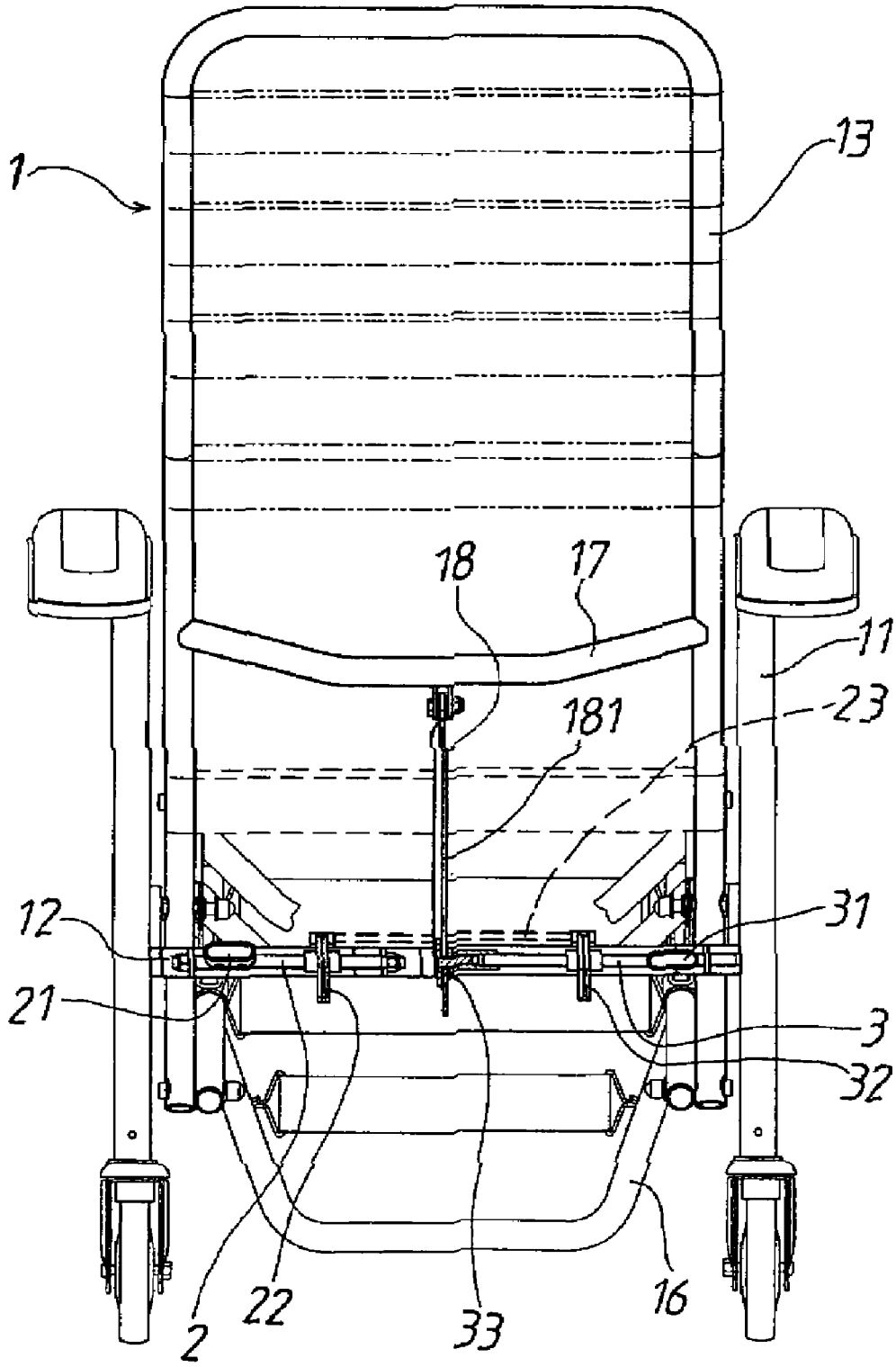
FIG. 4 is a rear view of the reclining chair in the present invention.
Figure 5:
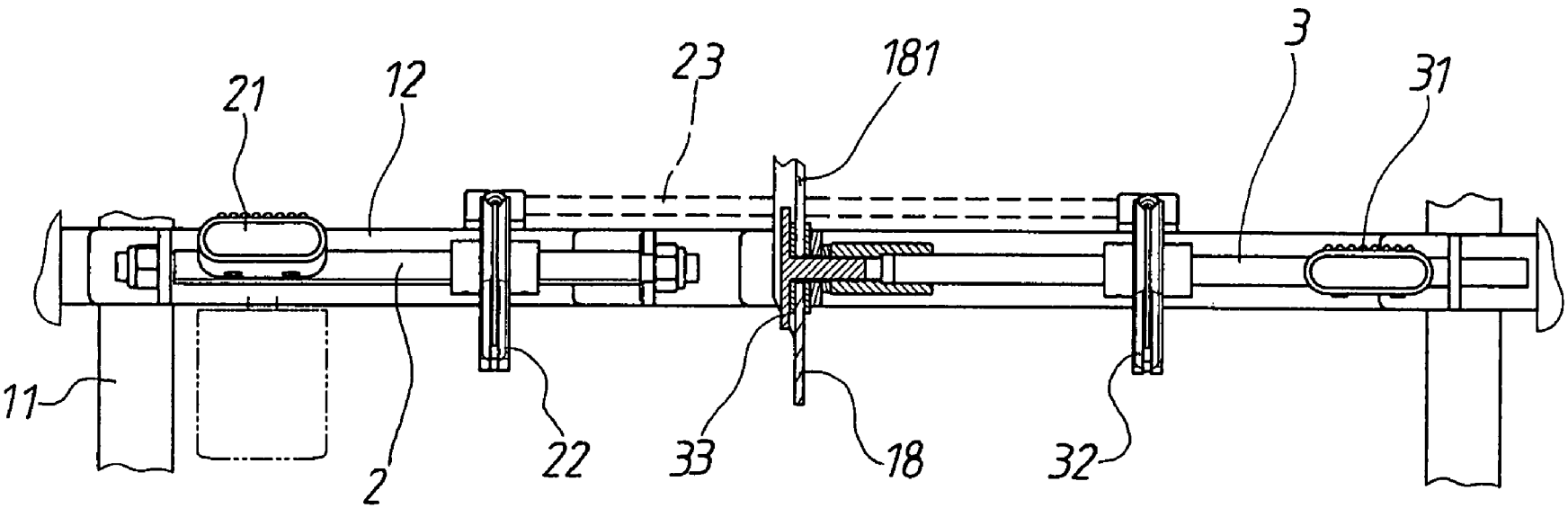
FIG. 5 is a partial rear view of the securing mechanism for the back of the reclining chair in the present invention.
Figure 6:
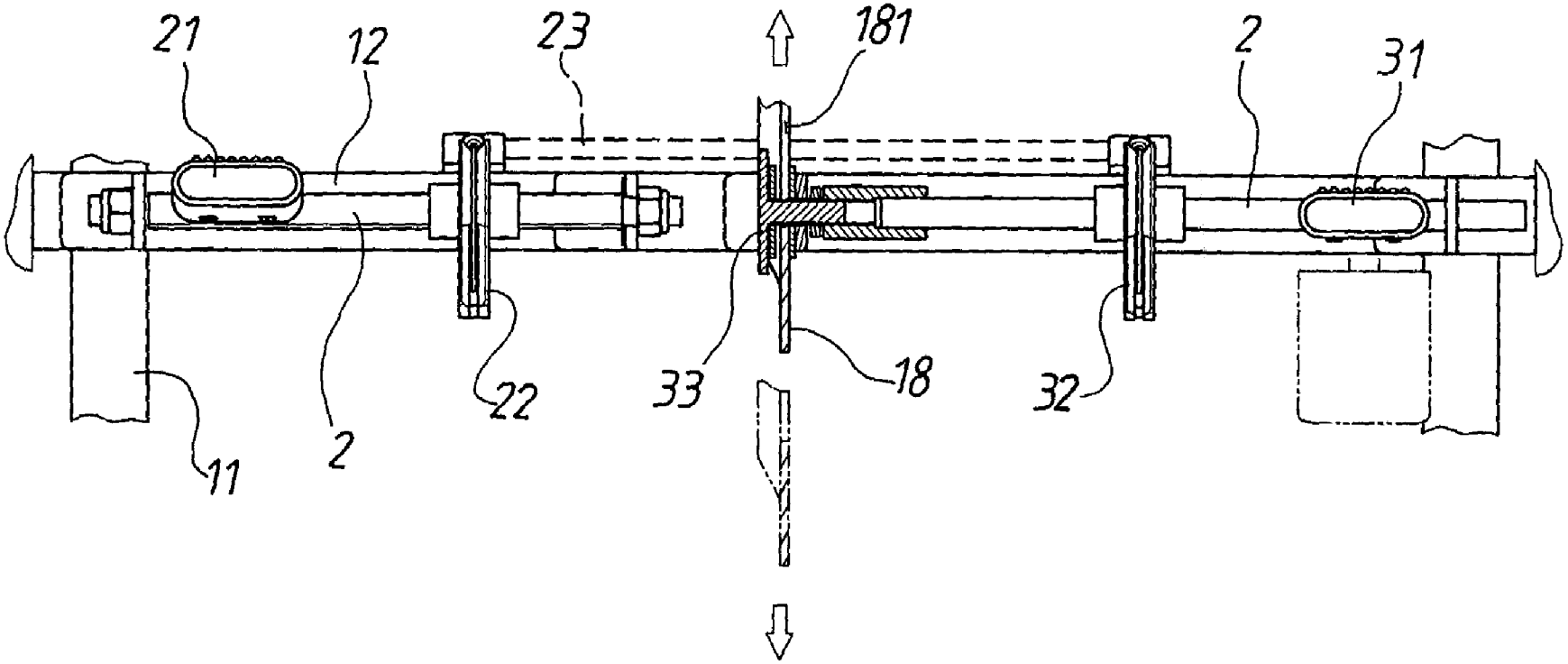
FIG. 6 is a partial rear view of the present securing mechanism, while the back is being adjusted.
Figure 7:
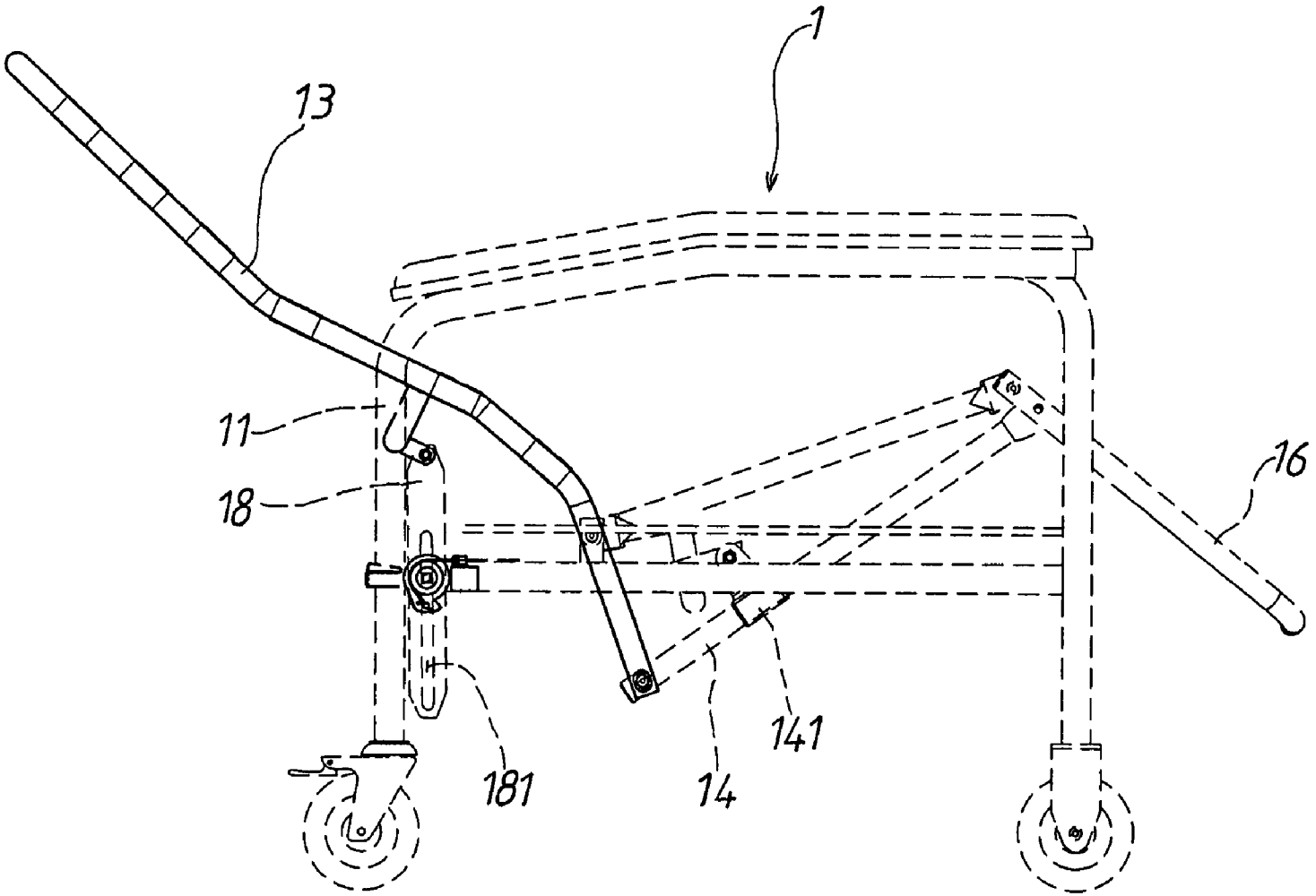
FIG. 7 is a side view of the present reclining chair with the back being in another position.
Figure 8:
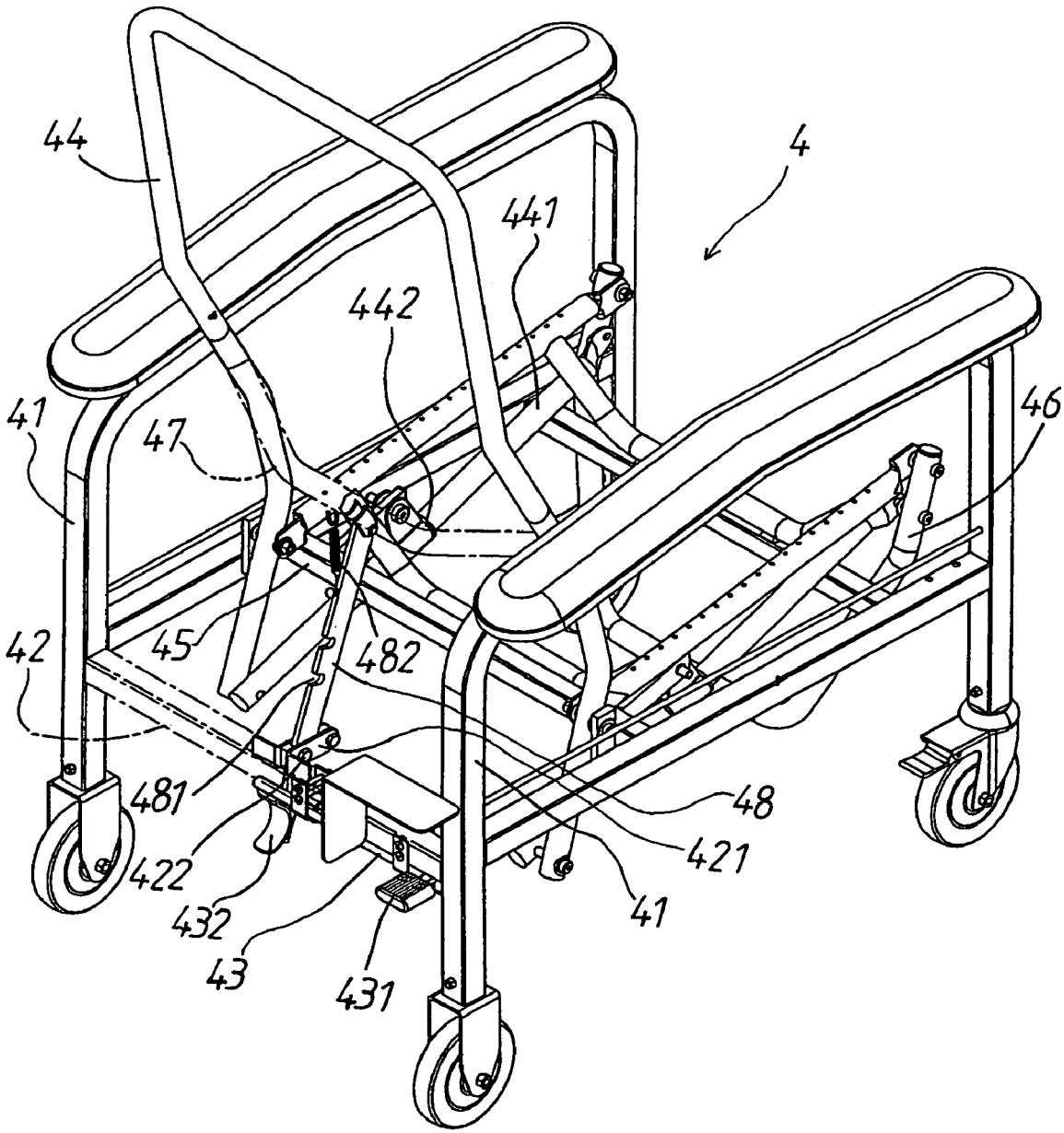
F I G. 8 (PRIOR ART)
FIG. 8 is a perspective view of the conventional reclining chair as described in Background.
Figure 9:
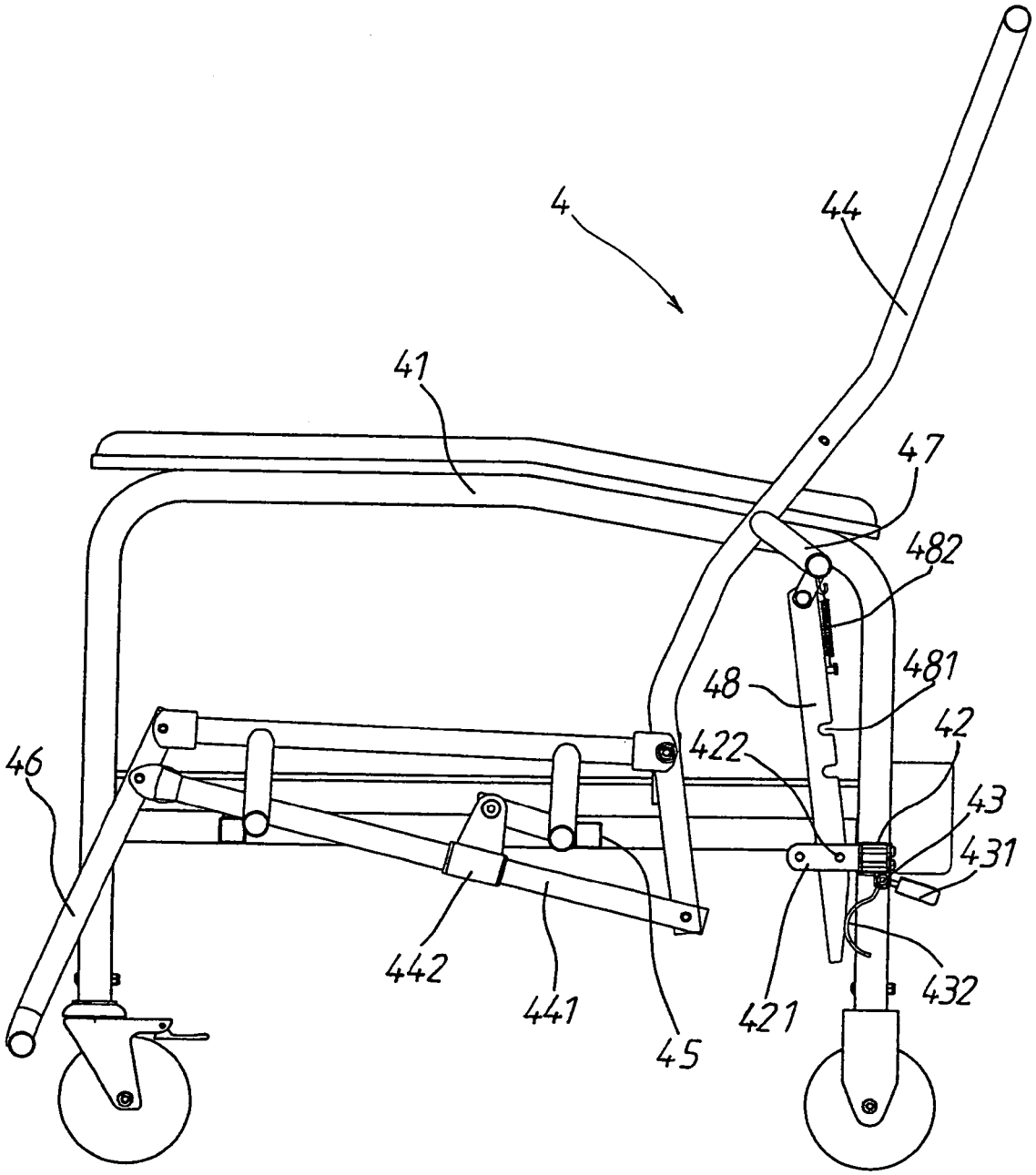
F I G. 9 (PRIOR ART)
FIG. 9 is a side view of the conventional reclining chair.

Referring to FIGS. 1 to 4, a preferred embodiment 1 of a reclining chair in the present invention includes a frame, a back 13, a footrest 16, a pair of connecting rods 14, and a securing mechanism, which is used for securing the back 13 after the same is angularly displaced to a suitable position.

The frame has two lateral parts 11, a first transverse rod 12 at the rear end thereof, and a second transverse rod 15 between the front and the rear ends thereof.

The back 13 is angularly displaceably fitted to the frame, and it has a transverse rod part 17, and a support rod 18, which is pivoted to the transverse rod part 17 at an upper end. The support rod 18 has a slot 181 lengthways extending thereon. The footrest 16 is pivoted to the front end of the frame.

In addition, two hollow holding elements 141 are fitted to the second transverse rod 15 of the frame. And, the connecting rods 14 are passed through the hollow holding elements 141 respectively, and they are pivoted to the back 13 at rear ends and the footrest 16 at front ends; thus, the footrest 16 and the back 13 can be simultaneously adjusted in position.

The securing mechanism includes a first rotary shaft 2 used for immobilizing the support rod 18 of the back 13, a second rotary shaft 3 used for making the support rod 18 free to move, and a steel string 23 connected to both the rotary shafts 2 and 3 such that rotation of one of the shafts 2 and 3 will cause rotation of the other one.

The first rotary shaft 2 is positioned parallel to and supported on the first transverse rod 12 of the frame, and it has a pedal 21 secured thereon, and a reel 22 secured thereto.

The second rotary shaft 3 is positioned parallel to and supported on the first transverse rod 12 of the frame, and it has a pedal 31 secured thereon, and a reel 32 secured thereto. In addition, a securing element 33 is connected to one end of the second rotary shaft 3 that is near to the slot 181 of the support rod 18 such that the securing element 33 can secure the support rod 18 in position as soon as it is turned to a first position, and such that the securing element 33 will separate from the support rod 18 as soon as it is turned from the first position to a second position. And, the steel string 23 is wound onto the reel 22 at one end, and wound onto the reel 32 at the other end such that the securing element 33 will be turned to the first position as soon as the pedal 21 is depressed, which is secured on the first rotary shaft 2, and such that the securing element 33 will be turned to the second position as soon as the pedal 31 is depressed, which is secured on the second rotary shaft 3.

Therefore, one should depress the pedal 31 to separate the securing element 33 from the support rod 18 before he carries out adjustment for both the back 13 and the footrest 16, which adjustment won't be possible unless the support rod 18 is free to move relative to the securing element 33. And, the user should depress the pedal 21 after the back 13 is angularly displaced to a desired position; the securing element 33 will secure the support rod 18 in position as soon as the pedal 21 is depressed, thus preventing the back 13 from moving.

From the above description, it can be understood that being equipped with the securing mechanism of the present invention, the back and the footrest of the reclining chair can be adjusted to any suitable reclining position. Therefore, the reclining chair is more ergonomically ideal than the conventional one described in Background.

What is claimed is:

1. An improvement on an adjustable reclining chair, comprising a frame having two lateral parts, a first transverse rod coupled between the two lateral parts at a rear end thereof, and a second transverse rod coupled between the two lateral parts intermediate the rear end and a front end of the frame;

a back fitted to the frame in an angularly displaceable manner; the back including a transverse rod part;

a support rod pivoted to the transverse rod part of the back at an upper end thereof; the support rod having a slot lengthways extending thereon;

a footrest fitted to the frame in an angularly displaceable manner;

a plurality of connecting rods pivoted to the back at rear ends and to the footrest at front ends for making the footrest and the back simultaneously movable; and a securing mechanism used for releaseably securing the back in position; the securing mechanism including:

(1) a first rotary shaft positioned substantially parallel to and supported on the first transverse rod of the frame, usable for immobilizing the support rod of the back; the first rotary shaft having a first pedal secured thereon, and a first reel secured thereto;

(2) a second rotary shaft positioned substantially parallel to and supported on the first transverse rod, usable for making the support rod of the back free to move; the second rotary shaft having a second pedal secured thereon, and a second reel secured thereto;

(3) a steel string having a first end wound onto the first reel, and a second end wound onto the second reel such that rotation of one of the shafts will cause rotation of the other shaft; and (4) a securing element connected to one end of the second rotary shaft that is near to the slot of the support rod; the securing element being formed in such a way as to be capable of securing the support rod in position as soon as it is turned to a first position, and capable of releasing the support rod for the back to be angularly displaced as soon as it is turned from the first position to a second position.

* * * * *